US011419405B2

(12) United States Patent
Schreiber

(10) Patent No.: US 11,419,405 B2
(45) Date of Patent: Aug. 23, 2022

(54) APPLICATOR FOR APPLYING A COSMETIC PRODUCT TO KERATINOUS MATERIALS

(71) Applicant: L'OREAL, Paris (FR)

(72) Inventor: Camille Schreiber, Clichy (FR)

(73) Assignee: L'OREAL, Paris (FR)

( * ) Notice: Subject to any disclaimer, the term of this patent is extended or adjusted under 35 U.S.C. 154(b) by 165 days.

(21) Appl. No.: 16/645,638

(22) PCT Filed: Oct. 9, 2018

(86) PCT No.: PCT/EP2018/077386
§ 371 (c)(1),
(2) Date: Mar. 9, 2020

(87) PCT Pub. No.: WO2019/072790
PCT Pub. Date: Apr. 18, 2019

(65) Prior Publication Data

US 2021/0401149 A1 Dec. 30, 2021

(30) Foreign Application Priority Data

Oct. 12, 2017 (FR) ..... 17 59554

(51) Int. Cl.

| | |
|---|---|
| ***A46B 11/00*** | (2006.01) |
| ***A45D 34/04*** | (2006.01) |
| ***A46B 3/16*** | (2006.01) |
| ***A46B 9/00*** | (2006.01) |

(Continued)

(52) U.S. Cl.
CPC ..... *A45D 34/046* (2013.01); *A45D 40/262* (2013.01); *A46B 3/16* (2013.01);
(Continued)

(58) Field of Classification Search
CPC .... A45D 34/046; A45D 40/262; A46B 9/005; A46B 9/021; A46B 2200/1053
(Continued)

(56) References Cited

U.S. PATENT DOCUMENTS 6,026,825 A * 2/2000 de Laforcade ..... A45D 40/265 132/218
6,312,180 B1 * 11/2001 Panda ..... A45D 40/265 401/130

(Continued)

FOREIGN PATENT DOCUMENTS

EP 1 362 524 A1 11/2003
EP 1362524 A1 * 11/2003 ..... A45D 33/34

(Continued)

OTHER PUBLICATIONS

U.S. Appl. No. 16/645,662, filed Mar. 9, 2020, Camille Schreiber.

(Continued)

*Primary Examiner* — Jennifer C Chiang
(74) *Attorney, Agent, or Firm* — Oblon, McClelland, Maier & Neustadt, L.L.P.

(57) ABSTRACT

An applicator for a cosmetic product to keratinous materials, particularly to keratinous fibers, notably to the eyelashes, the eyebrows and/or the capillary fibers, includes a core that extends along a longitudinal axis, a cosmetic product application element having at least one block of a foam attached to the core, the foam being an open-cell polymer foam which on its outer surface has free strands formed by all or part of the edge corners of cells that have been cut through by the machining of the foam.

22 Claims, 6 Drawing Sheets

(51) Int. Cl.
*A46B 9/02* (2006.01)
*A45D 40/26* (2006.01)

(52) U.S. Cl.
CPC ..... *A46B 9/005* (2013.01); *A46B 9/021* (2013.01); *A45D 2200/1018* (2013.01); *A46B 2200/1053* (2013.01)

(58) Field of Classification Search
USPC ..... 401/129
See application file for complete search history.

(56) References Cited

U.S. PATENT DOCUMENTS

| | | | | |
|---|---|---|---|---|
| 2001/0046406 | A1* | 11/2001 | Schrepf | A46B 3/18 401/126 |
| 2006/0249168 | A1 | 11/2006 | Smit | |
| 2020/0352308 | A1* | 11/2020 | Schreiber | A46B 15/00 |

FOREIGN PATENT DOCUMENTS

| | | | |
|---|---|---|---|
| FR | 2 855 379 | A1 | 12/2004 |
| FR | 2 896 678 | A1 | 8/2007 |
| FR | 3 023 458 | A1 | 1/2016 |
| JP | 11-11512 | A | 1/1999 |
| WO | WO 2013/026853 | A1 | 2/2013 |

OTHER PUBLICATIONS

International Search Report dated Nov. 2, 2018 in PCT/EP2018/077386 filed on Oct. 9, 2018, 3 pages.
French Preliminary Search Report dated Jun. 5, 2018 in French Application No. 1759554 filed on Oct. 12, 2017, 2 pages.
Japanese Office Action dated Aug. 2, 2021 in Japanese Patent Application No. 2020-520453 (with unedited computer generated English translation), 8 pages.

* cited by examiner

APPLICATOR FOR APPLYING A COSMETIC PRODUCT TO KERATINOUS MATERIALS

FIELD OF THE INVENTION

The present invention relates to an applicator for applying a cosmetic product to keratinous materials, particularly to keratinous fibres, notably to the eyelashes and/or eyebrows, and/or capillary fibres, and also to a packaging and application device comprising such an applicator and to a container containing the product to be applied.

DISADVANTAGES OF THE PRIOR ART AND OBJECTIVES OF THE INVENTION

Numerous mascara applicators comprising a brush having a core formed by two metal arms that are twisted together and grip fibres or bristles, are known.

Numerous mascara applicators which are injection moulded in plastic and commonly referred to as plastic brushes are also known, these having projecting elements that are moulded with the core and for example form teeth to bring a cosmetic product onto the keratinous fibres while at the same time combing or separating same.

An applicator for applying a product to the keratinous fibres and comprising a support and a plurality of application elements formed of hooks and/or loops borne by a tape attached to the support is also known, from FR 2 855 379.

Finally, an applicator for a cosmetic product, comprising a core comprising a plurality of reliefs to form a brush and an end-piece situated in the continuation of the core is known, from FR 3 023 458. The core, the reliefs and the end-piece form a single component made of the one same material. This material is chosen from plant fibres, thermoplastic fibres, for example elastically deformable fibres, a frit and a foam. The material choice is made in such a way as to confer sufficient stiffness in the application zones that are the reliefs and the end-piece, the application zones having not to become deformed as they pass through a wiper, and also as to exhibit a cosmetic product absorption capability that allows a reserve of product to be formed for application by capillarity by the end-piece.

WO 2013/026853 discloses a method for manufacturing a cosmetic product applicator, the method comprising the steps of supplying an insert and attaching a flexible foam tip onto the insert.

US 2006/0249168 relates to a nail polish applicator utilizing a tapered, absorbable, foam tip so that nail polish may be applied more precisely, more uniformly and with less mess.

EP 1 362 524 is directed to an applicator consisting of a fibrous or cellular element having part of its surface used for application which is covered with projecting fibres made from the same material as that part of the surface.

There is a need to improve applicators for applying a cosmetic product to the eyelashes, the eyebrows and/or the capillary fibres, notably so as to enjoy applicators capable of satisfactorily making-up the eyelashes or the eyebrows and/or of applying a cosmetic product, such as a care or coloration product, to the capillary fibres by bringing a sufficient load of product onto, and correctly combing through, the eyelashes, eyebrows and/or capillary fibres.

SUMMARY OF THE INVENTION

Applicator

The present invention seeks to meet this need and the subject of the invention, in one of the aspects thereof, is an applicator of cosmetic product to keratinous materials, particularly to keratinous fibres, notably to the eyelashes, the eyebrows and/or the capillary fibres, comprising at least:

- a core that extends along a longitudinal axis,
- a cosmetic product application element, comprising at least a block of foam attached to the core, the foam being an open-cell polymer foam which on its outer surface has free strands formed by all or part of the edge corners of cells that have been cut through by the machining of the foam.

By virtue of the invention, the applicator comprises a reserve of product formed by the cells of which the foam is made, which may become laden with product. In addition, the ends formed by the free strands allow the eyebrows, eyelashes and/or capillary fibres to be combed, separated and/or lengthened gently. That makes it possible to avoid damaging and/or pulling out the eyelashes, the eyebrows and/or the capillary fibres, while at the same time obtaining a result that is satisfactory in terms of combing, separation and deployment of the eyelashes in particular.

The length of the free strands may be comprised between approximately 0.1 mm and 4 mm, preferably between 0.5 mm and 2 mm.

It should be noted that, for the one same applicator, the length of the free strands will generally not be constant, because of the fact that they are obtained by the machining of the foam. Some strands will be short, for example with a length equal to approximately 0.1 mm, whereas other strands will be longer, up to a total length equal to the length of an edge corner of a cell of the foam, for example 4 mm. Thus, the mean length of the free strands may be comprised between 0.5 mm and 2 mm.

The foam is, for example, machined by a punch, by a laser, by milling and/or by waterjet. Machining by milling is particularly advantageous in the context of the present invention, because such a machining method allows an applicator with an envelope surface of complex shape to be produced easily.

The machining of the foam makes it possible to create on the exterior surface of the foam the free strands which will comb the eyelashes, eyebrows and/or capillary fibres. The cells of the foam themselves make it possible to constitute reserves of product in the immediate vicinity of the combing strands.

The foam is advantageously selected from cross-linked polymer foams. The cross-linking may allow the circulation of fluids through the foam, forming open porosity.

The foam is selected for example from cross-linked thermoplastic foams, notably cross-linked polyurethane, cross-linked polyester, cross-linked polyether or cross-linked polyethylene.

A polymer foam in general is to be understood as meaning a cellular material, or material with pockets, made from a polymer and made up of a three-dimensional structure formed by a solid skeleton comprising solid walls and/or solid edge corners, surrounding pockets or cells with spatially random orientations.

In a polymer foam, the porosity, which is all of the voids created by the pores, or cells or pockets, exceeds 70% of the total volume of the foam.

What is meant by an "open porosity polymer foam" is the fact that the cells of this material are open to the adjacent cells and to the outside. In this case, it is only the edge corners surrounding the cells that form the solid skeleton of the foam. There are no solid walls. The shape of the cells may be spherical or polyhedral.

The number of cells per unit length, more commonly referred to as the PPI (Pores Per Inch) characterizes the polymer foam. It corresponds to the number of pores, or cells or pockets, intercepted in a length of 1 inch (2.54 cm).

The foam advantageously has a number of cells per unit length (PPI) comprised between 10 and 80 PPI.

The foam preferably has a number of cells per unit length comprised between 20 and 50 PPI, better equal to around 30 PPI.

In order to measure the number of cells per unit length as a PPI value, it is possible, as visible in FIG. 4, to use a ruler to visually measure the number of cells per unit length. 10 PPI thus corresponds to 10 cells per inch, namely to 10 cells per 2.54 cm. FIG. 4 illustrates six foams placed one after another, along the ruler, exhibiting different PPI values of 8, 10, 15, 20, 25 and 30 PPI respectively, with the PPI value increasing down the figure.

Furthermore, the foam advantageously has a density comprised between 15 kg/m$^3$ and 60 kg/m$^3$.

The foam preferably has a density comprised between 20 kg/m$^3$ and 40 kg/m$^3$, better equal to approximately 30 kg/m$^3$.

Such ranges of foam cells per unit length (PPI) and/or density parameters are particularly advantageous in the context of use of the applicator according to the invention for applying a cosmetic product such as a mascara composition or a colouration product and/or a care product for capillary fibres.

A mascara composition conventionally has a viscosity greater than 5 Pa.s, notably comprised between 5 Pa.s and 50 Pa.s, at 25° C., in particular measured with the aid of a Rheomat RM100® machine.

Such a mascara composition conventionally comprises a solids content, generally in an amount greater than or equal to 35% by weight relative to the total weight of the composition, a pulverulent colorant, in particular one or more pigments, notably one or more metal oxides, for example one or more iron oxides, and advantageously a film-forming polymer. A mascara composition may also conventionally comprise one or more waxes, in a total amount of in particular between 5 and 40% by weight relative to the total weight of the composition.

Thus, such ranges of foam cells per unit length (PPI) and/or density make it possible to obtain an applicator that demonstrates a good compromise between its abilities to retain and to release a cosmetic product having a viscosity comprised between 5 Pa.s and 50 Pa.s, notably comprised between 9 Pa.s and 25 Pa.s.

The product retention capacities of an applicator according to the invention in particular make it possible to prevent the cosmetic product held within the foam of the applicator from flowing under gravity through this applicator, thus improving the cleanliness and autonomy of such an applicator. The retention of cosmetic product within the foam of the applicator is achieved in particular by surface tension of the product held inside the cells present in the foam.

The product-release capacities of an applicator according to the invention in particular make it possible for the product held within the foam of the applicator to be loaded onto the eyelashes/eyebrows and/or the capillary fibres when these are brought into contact with the applicator. The release of the cosmetic product held within the foam of the applicator is achieved in particular by bringing the eyelashes, eyebrows and/or capillary fibres into contact with the cells of the foam, this contact breaking the surface tension that there is between the product and the cells of the foam, the product then being deposited on the eyelashes, eyebrows and/or capillary fibres.

By way of example, use may be made of a black-coloured polyester polyurethane foam with a density (in accordance with standard ISO 1855) of 29kg/m$^3$ (+ or −3kg/m$^3$). By way of example, the PPI value of such a material may be 20 PPI. In this case, the load-bearing capacity (in accordance with standard ISO 3386/1) is 3.7 kPa (+ or −1), the elongation at break (in accordance with standard ISO 1798) is greater than 120% and the tensile strength (in accordance with standard ISO 1798) is greater than 80 kPa. The PPI value may be 30 PPI. In this case, the load-bearing capacity (in accordance with standard ISO 3386/1) is 3.7 kPa (+ or −1), the elongation at break (in accordance with standard ISO 1798) is greater than 150% and the tensile strength (in accordance with standard ISO 1798) is greater than 95 kPa. The PPI value may even be equal to 45 PPI. In this case, the load-bearing capacity (in accordance with standard ISO 3386/1) is 3.8 kPa (+ or −1), the elongation at break (in accordance with standard ISO 1798) is greater than 180% and the tensile strength (in accordance with standard ISO 1798) is greater than 100 kPa. The PPI value may even be equal to 60 PPI. In this case, the load-bearing capacity (in accordance with standard ISO 3386/1) is 4.2 kPa (+ or −1), the elongation at break (in accordance with standard ISO 1798) is greater than 200% and the tensile strength (in accordance with standard ISO 1798) is greater than 140 kPa. The PPI value may also be 80 PPI. In this case, the load-bearing capacity (in accordance with standard ISO 3386/1) is 4.2 kPa (+ or −1), the elongation at break (in accordance with standard ISO 1798) is greater than 230% and the tensile strength (in accordance with standard ISO 1798) is greater than 170 kPa. Of course, intermediate PPI values are possible.

The application element, particularly the block of foam, may at least partially surround the core in cross section.

In that case, the block of foam may completely surround the core in cross section. So the applicator may then constitute a brush.

The block of foam may alternatively partially surround the core, over an angular spread, measured about the longitudinal axis of the core, comprised between 90° and 240°, or better, between 120° and 200°. In this case, the applicator may constitute a comb, the core then forming a support for the foam.

The foam is, for example, machined by a punch, by a laser, by milling and/or by waterjet. Machining by milling is particularly advantageous in the context of the present invention, because such a machining method allows an applicator with an envelope surface of complex shape to be produced easily.

The machining of the foam makes it possible to create on the exterior surface of the foam the free strands which will comb the eyelashes or eyebrows. The cells of the foam themselves make it possible to constitute reserves of product in the immediate vicinity of the combing strands.

The envelope surface formed by the exterior surface of the application element, notably by the block of foam after machining, may exhibit various shapes. The envelope surface may, for example, exhibit an overall shape selected from the group consisting of a cylindrical shape, and ogive shape, an ovoid shape, a rugby-ball shape, a frustoconical shape, a conical shape, a biconical shape, a peanut shape, a diabolo shape, a shape exhibiting axial symmetry, a shape with no axial symmetry, a shape with reliefs, notably notches, grooves, ribs, slots, and any combination of these shapes.

The core may have different shapes and materials. In particular, the core may be selected from a core having two arms, notably U-shaped metal arms, twisted together, which may or may not trap fibres, a rod made from a metallic material, a polymer-based core, and a combination of these.

The core is not made from the foam of the foam block. The core is made from a material having a stiffness higher than that of the foam of the foam block. The longitudinal axis of the core may be curved or rectilinear or form at least one angle.

The foam may be attached to the core in various ways. For example, the foam is attached to the core by welding, notably ultrasonic welding, by bonding and/or by mechanical fastening, notably by crimping or by one or more retaining elements and/or a retaining stop, this list being nonlimiting. Several attachment methods may be used in combination.

The core may comprise at least one retaining relief which at least partially penetrates the foam.

The core may be provided with fibres, notably trapped within a core having two arms, notably U-shaped metal arms, twisted together, which at least partially passes through the foam. In this case, the fibres, which are advantageously short in length and do not protrude beyond the exterior surface of the foam, are able to hold or even attach the foam on the core, and form retaining elements.

The length of some of the fibres may be chosen in such a way as to be greater, only partially, in one or more zones, than the thickness of the foam, when this foam is in a relaxed state, so that this part of the fibres projects from the exterior surface of the foam in the zone(s) concerned. The application element may comprise, along the longitudinal axis of the core, and for example placed side-by-side, at least one zone with the block of foam and at least one zone provided with projecting elements such as fibres or teeth, the latter zone advantageously being configured so that it also allows the application of cosmetic product. In this case, the application element is formed by these two (or more) different application zones on the one same applicator. The or a zone provided with projecting elements may be positioned at a distal end of the applicator. In this case, it may form a retaining end stop for said at least one block of foam.

As an alternative, the application element is formed only by said at least one block of foam.

The applicator may comprise a stem, the core being attached to the stem. In this case, the core may have a distal end and a proximal end, the proximal end being attached to the stem, the distal end being able to comprise a foam retaining end stop.

In one particular embodiment, the block of foam is fixed by means of a core having a distal portion onto which the block of foam is slipped. The distal portion is connected to a proximal portion of the core by an articulation such as a film hinge. The distal portion is folded back onto the proximal portion, complementary reliefs holding the distal portion on the proximal portion.

The block of foam can even be attached to the core by interacting hooks and loops, particularly a velcro® system. For example, the hooks may be provided on the core and the loops may consist of the cellular pockets of the foam. As an alternative, provision may be made for securing tapes of the Velcro® type, loops on the one hand and hooks on the other, to be attached to the core and to the foam.

The cosmetic product may be a mascara for the eyelashes or the eyebrows or a cosmetic product such as a colouration or care product for human keratinous materials, notably capillary fibres. The viscosity of the cosmetic product may be comprised between around 100 and 250 centipoise.

Packaging and Application Device

A further subject of the invention, in combination with the foregoing, is a device for packaging and applying a cosmetic product, notably to the eyelashes, the eyebrows and/or the capillary fibres, comprising:

an applicator as defined above, a container containing the cosmetic product to be applied.

In instances in which the applicator comprises a stem, the core being attached to the stem, the stem of the applicator may be secured to a cap that closes the container.

The container may then comprise a wiping member for wiping at least the application element as the applicator is withdrawn from the container.

Method of Manufacture

A further subject of the invention, in combination with the foregoing, is a method for manufacturing an applicator as defined above, comprising the following steps:

machining the exterior surface of the foam, attaching the core to the foam.

The step of machining the foam may take place after the step of attaching the core to the foam. That makes it possible to turn the foam during machining, making it possible to achieve complex shapes. As an alternative, the step of machining the foam may take place before the step of attaching the core to the foam.

When the core comprises two arms, notably U-shaped metal arms, the step of attaching the core to the foam may consist in piercing the block of foam with the two arms and then twisting the arms together.

In instances in which the core comprises two arms, notably U-shaped metal arms, twisted together and trapping fibres between them, the attachment step may consist in making the core pass through the block of foam, notably through a slot provided therein. A step of cutting at least some of the fibres over at least a portion of their length prior to securing to the foam may be provided.

The step of securing the core to the foam may, as an alternative or in addition, involve bonding, welding and/or mechanical fastening, notably crimping or retention using one or more retaining element(s) and/or a retaining stop.

In order to attach the foam, the core may have a distal portion connected to a proximal portion by an articulation such as a film hinge, the method then comprising a step that consists in slipping the block of foam onto the distal portion and then folding the distal portion back onto the proximal portion, complementary reliefs then holding the distal portion on the proximal portion.

There is no need to treat the exterior surface of the foam, simply to machine same.

BRIEF DESCRIPTION OF THE FIGURES

The invention may be understood better from reading the following detailed description of nonlimiting exemplary embodiments thereof and from studying the appended drawing, in which.

DETAILED DESCRIPTION OF EMBODIMENTS

In the rest of the description, identical elements or elements having equivalent functions bear the same reference signs. Their description is not repeated for each of the figures, only the main differences between the embodiments being highlighted.

Figure 1:
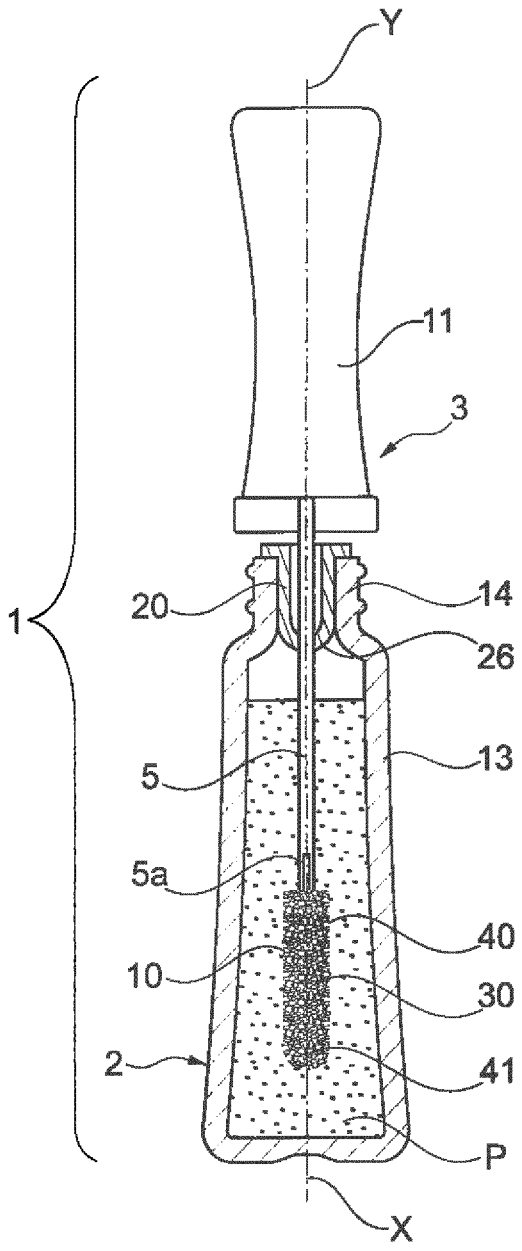
FIG. 1 shows an example of a packaging and application device according to the invention, in schematic longitudinal section.

The packaging and application device 1 depicted in FIG. 1 comprises a container 2 containing a product P to be applied to the eyelashes or the eyebrows and an applicator system 3 which may, in the example in question, be attached removably to the container 2. The product P comprises, for example, one or more pigments, notably an iron oxide. It is preferably a mascara.

The applicator system 3 comprises, in this example, a stem 5 of longitudinal axis Y, which stem 5 is provided at a distal end 5*a* with an applicator 10 according to the invention and at the other end with a gripping member 11, which also forms a cap for closing the container 2 in a sealed manner. As can be seen notably in FIG. 1, said container comprises a body 13 provided at the top with a threaded neck 14 onto which the gripping member 11 can be screwed in order to close the container 2 in a sealed manner. As an alternative, the applicator system may be attached to the container in some other way.

As illustrated, the neck 14 is able to receive a wiping member 20 which, for example, is attached therein. This wiping member 20 has a lip 26 defining a wiping orifice of a diameter suited to that of the stem 5.

The applicator 10 may be attached, in a conventional manner, in a housing provided at the distal end 5*a* of the stem 5, which stem is advantageously made of a thermoplastic material.

The applicator 10 in this example comprises a core 40 which is attached at one end into the corresponding housing in the stem 5 by a core portion that has no application element 30, which portion may be of a length of the order of 8 mm. The exterior surface 46 of the application element 30 defines an envelope surface S of the applicator 10, which surface is indicated in dotted line in FIG. 2A.

Figure 2A:
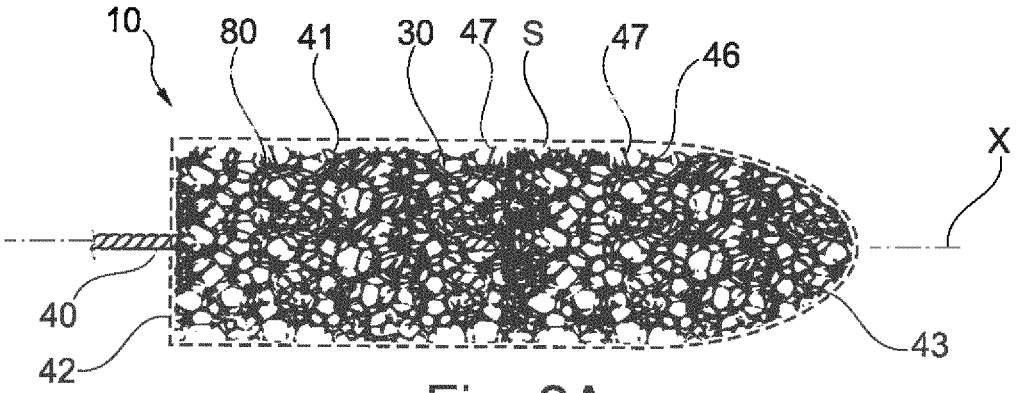
FIG. 2A is a schematic side view of an applicator according to one exemplary embodiment according to the invention.
Figure 2B:
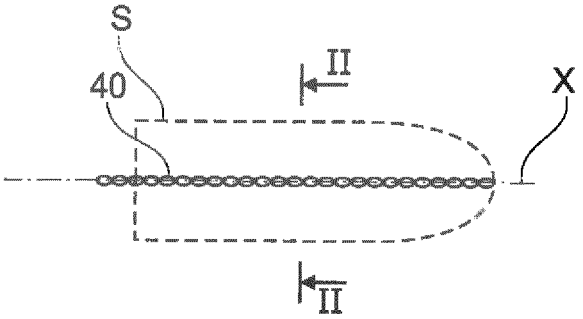
FIG. 2B is a partial schematic view in longitudinal section of the applicator of FIG. 2A.
Figure 2C:
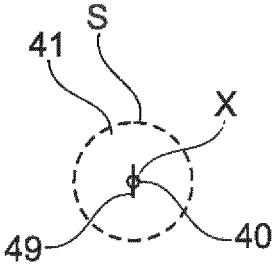
FIG. 2C is a schematic view in section on II of FIG. 2B.

The application element 30 comprises, as visible in FIG. 2A, a block 41 of a foam 80 which is attached to the core 40. The foam 80 surrounds the core 40 in cross section, in this example completely as visible in FIG. 2C. The applicator 10 in this example forms a brush. In the example illustrated, the core 4 comprises two twisted metal arms, visible in FIG. 2B and which, during manufacture of the applicator 10, have been introduced into a longitudinal slot 49 made at the centre of the block 41 of foam, as visible in FIG. 2C, over a portion of the length thereof, for example over more than 90% of the length thereof. The foam 80 is attached to the core 40 by bonding, in this example.

The shape of the envelope surface S, when viewed from the side, is that of an ogive, with a proximal end 42 of the applicator 10 which is straight, whereas a distal end 43, that forms the free end of the applicator 10, is rounded in this example. In cross section, as visible in FIG. 2C, the block 41 of foam has a circular shape. The foam 80 has been machined, before or after attachment to the core 40, so as to form free strands 47 on its exterior surface 46 that forms the envelope surface S. Finally, in this example, the applicator 10 is secured to the stem 5 in the housing provided for that purpose, as explained above.

Figure 3:
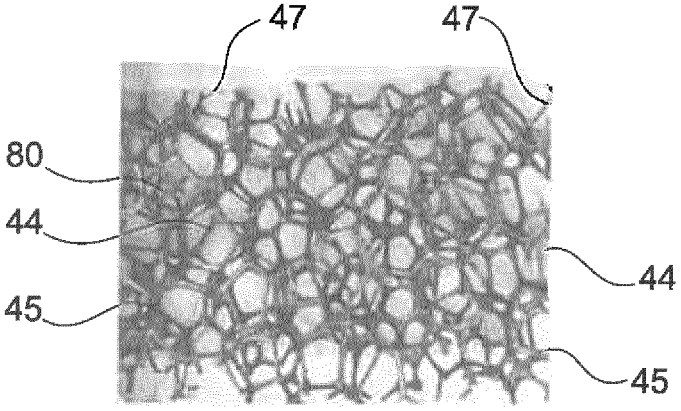
FIG. 3 is an enlarged view of one example of foam that can be used for creating an applicator according to the invention.
Figure 4:
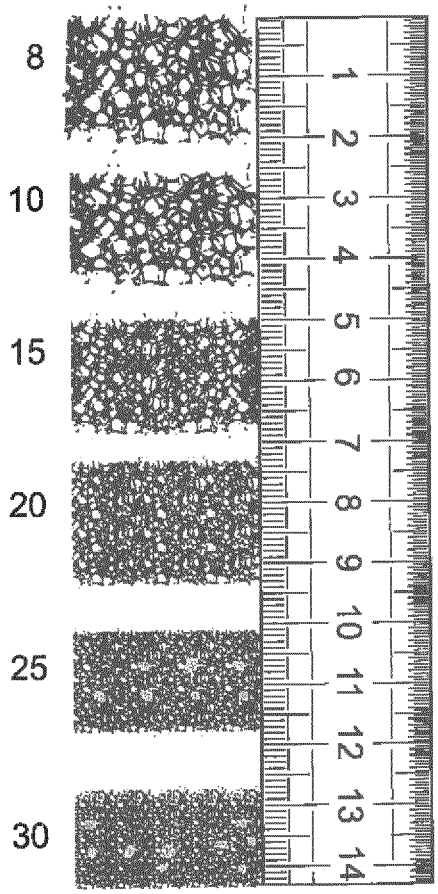
FIG. 4 is a schematic view illustrating several blocks of foams exhibiting different PPI values and the method for measuring these values, FIG. 5A schematically depicts, in a side view, another example of an applicator according to the invention.

As visible in FIG. 3 which is an enlarged illustration of one example of a foam that can be used to produce the application element 30, the foam 80 is a cross-linked polymer foam with open porosity, which means to say which forms cells 44 which constitute reserves of product delimited from one another only by edge corners 45. The free strands 47 are formed by edge corners 45 which have been cut during the machining. The strands 47, visible in FIGS. 2A and 3, serve to comb the eyelashes or eyebrows, while the cells 44 form reserves of product.

The length of the strands 47 is comprised between 0.1 mm and 4 mm, preferably between 0.5 mm and 2 mm, it being understood that, particularly because of the random nature of the positioning of the cells within the foam 80, the strands 47 have mutually different lengths.

In the example illustrated in FIGS. 1 and 2A, the foam 80 used is a cross-linked polyurethane foam (PUR), the density of the foam 80 is approximately 30 kg/m$^3$, and the number of cells 44 per unit length is approximately 30 PPI.

When the applicator 10 is used for applying make up to the eyelashes or eyebrows, the user appreciates the softness of the foam 80 in contact with the keratinous fibres, and at the same time appreciates the effectiveness of the making-up, with a good load of cosmetic product in reserve in the cells 44 of the foam and satisfactory combing of the eyelashes or eyebrows by the free strands 47.

Figure 5A:
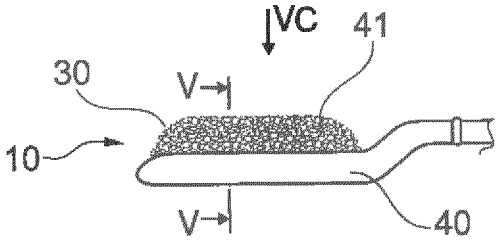
FIG. 5B is a view in cross section on V of FIG. 5A.
FIG. 5C is a schematic and partial view from above, on VC of FIG. 5A.
Figure 5B:
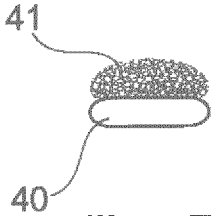
Figure 5C:
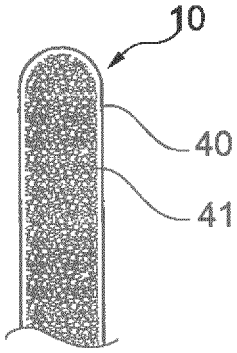

FIGS. 5A to 5C depict the possibility that the block of foam 41 does not completely surround the core 40 but covers just part thereof. In the example illustrated in FIG. 5, the core 40 forms a support for a block 41 of foam, so as to form a comb. Still in this example, the core 40 is produced by moulding in plastic, and the block 41 of foam is attached to the core 40 by welding, notably ultrasonic welding, at least in places.

Figure 6A:
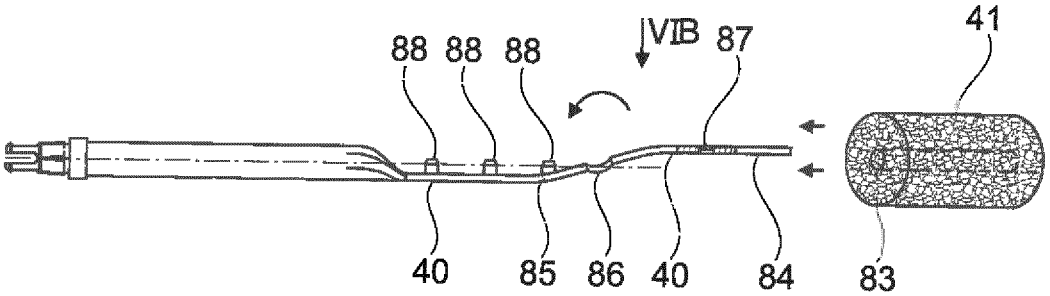
FIG. 6A is a schematic side view, prior to the attachment of the foam to the core, of another example of an applicator according to the invention.
Figure 6B:
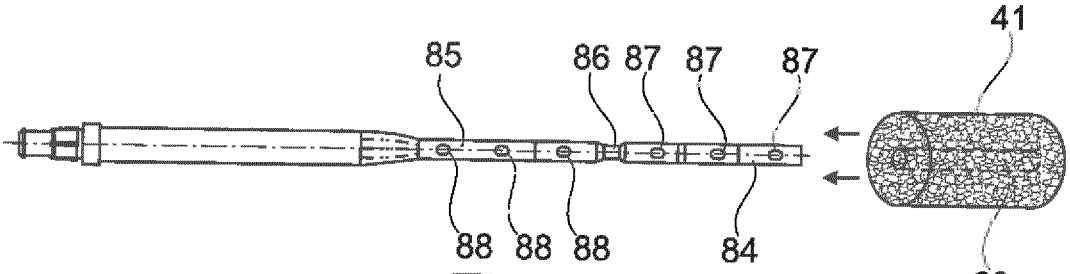
FIG. 6B is a schematic view from above, in the direction of arrow VIB of the example of an applicator in FIG. 6A.
Figure 7:
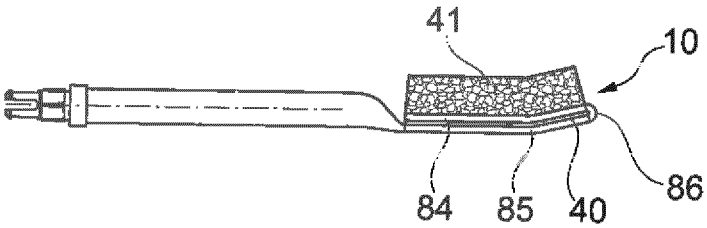
FIG. 7 is a schematic and partial side view of the applicator of FIGS. 6A and 6B after attachment, FIGS. 8A to 8E schematically illustrate, in side view, various elements and steps involved in creating an example of the applicator illustrated in FIG. 8E.

FIGS. 6A, 6B and 7 depict another way of attaching the block 41 of foam to the core 40.

FIGS. 6A and 6B show the block 41 of foam, of cylindrical shape, pierced centrally with an opening 83 which in this example is central and cylindrical.

The core 40 comprises a distal portion 84 and a proximal portion 85 which are joined together by an articulation 86, in this example formed by a film hinge.

Mounting the applicator 10 begins with the distal portion 84 being slipped into the opening 83 in the block 41 of foam, or directly through the block 41 of foam if this block does not have an opening 83, in the direction of the two parallel arrows illustrated in FIGS. 6A and 6B. This assembly formed by the distal portion 84 and the block 41 of foam is then pivoted about the articulation 86 in the direction of the curved arrow in FIG. 6A, until the distal portion 84 is attached to the proximal portion 85.

Complementary reliefs 87 and 88 are arranged respectively on the distal portion 84 and the proximal portion 85 and allow these portions to be held together. The result is visible in FIG. 7. In the example illustrated, the reliefs 87 present on the distal portion 84 are orifices, three of them, which complement projecting reliefs 88 of the proximal portion 85. The reliefs 88 at their free end have a bead allowing them to be fixed in the orifices 87 in such a way as to secure the distal portion 84 to the proximal portion 85, trapping part of the block 41 of foam, as illustrated in FIG. 7.

Part of the block 41 of foam is compressed between the distal 84 and proximal 85 portions of the core 40. In this example, the machining of the block 41 of foam is preferably performed before this block is attached to the core 40.

The various elements involved in implementing one example of a manufacturing method according to the invention, to produce the applicator 10, are depicted in FIGS. 8A to 8E.

Figure 8A:
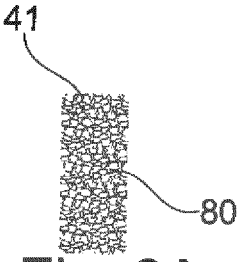

A block 41 of foam of cylindrical shape visible in FIG. 8A is produced.

Figure 8B:
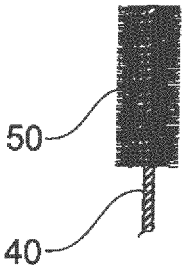

A core 40 formed by two metal arms twisted together trapping fibres 50, as visible in FIG. 8B is also produced.

Figure 8C:
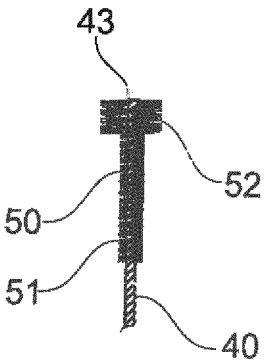
Figure 8D:
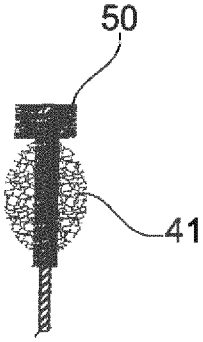

Then part of the height of certain fibres 50 is cut by trimming, so as to obtain, as can be seen in FIG. 8C, a zone 51 with fibres 50 of short length and a zone 52 with uncut fibres 50 of longer length. In this example, the zone 52 lies near the distal end 43 and comprises said end. This zone 52 allows the application of product and the separation of the eyelashes, particularly the eyelashes at the corner of the eye, or of the eyebrows during the application of make up.

Then the foam 80 is secured by passing through it, after having or having not created a longitudinal slot in the foam, the core 40 with the fibres 50. The result is visible in FIG. 8D.

Figure 8E:
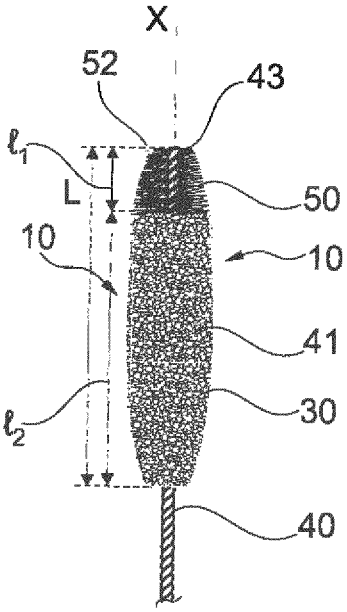

Finally, the block 41 of foam and the fibres 50 of the zone 52 are machined, for example by milling or waterjet cutting, to obtain the applicator 10 illustrated in FIG. 8E of ovoid shape. It should be noted that the applicator 10 can be rotated during cutting, thereby allowing complex shapes to be achieved.

It should also be noted that the shorter-length fibres 50 in the zone 51 are present under the foam 80 and penetrate the latter, forming retaining elements that allow the foam 80 to be attached to the core 40. In this example, the application element 30 of the applicator 10 therefore comprises a part formed by the block 41 of foam and a distal part formed by the fibres 50 of the zone 52. That makes it possible to have different application zones, something which may be advantageous for applying make up. The zone 52 also forms a retaining end stop preventing any movement of the foam on this side.

In the example of FIG. 8E, the length $l_1$ of the zone 52 forms approximately ⅙ of the total length L of the application element 30, whereas the length $l_2$ occupied by the block 41 of foam is approximately ⅚, $l_1+l_2=L$.

Figure 9:
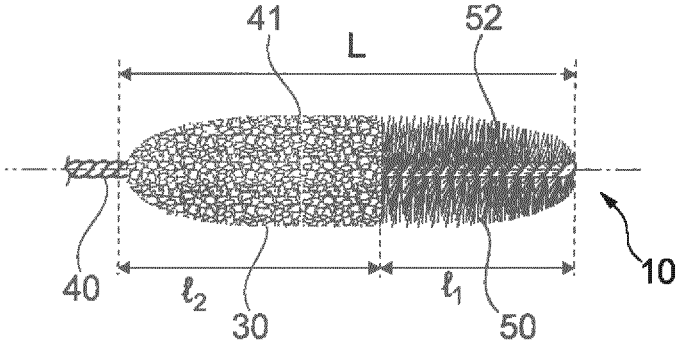
FIG. 9 illustrates another example of an applicator according to the invention, in schematic side view.

In the example of FIG. 9, the applicator 10 is similar to that of FIG. 8E but the length $l_1$ of the zone 52 is a little greater than ⅓ of the length L, the length $l_2$ of the block 41 of foam being a little less than ⅔.

In another embodiment, the fibres of the core 40 comprising twisted arms trapping the fibres 50 are all cut to a short length, or all have a short length, for example less than 4 mm, or better, less than 2 mm, measured from the core 40, and are therefore all covered with the foam 80. In that case, the fibres 50 serve to hold the foam on the core.

Other arrangements for the applicator 10 may also be envisaged.

Figure 10:
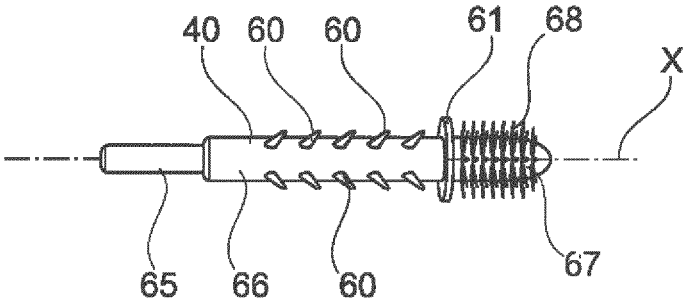
FIGS. 10 to 13 illustrate, in schematic side view, various examples of applicator according to the invention.

FIG. 10 depicts in isolation a core 40 made from an injection moulded thermoplastic. The core 40 comprises, along the longitudinal axis X and in succession, a smooth and cylindrical first part 65, for attachment to a stem, for example, or to form a zone for grasping; a central second part 66 with retaining elements 60 forming barbed hooks which are inclined with respect to the longitudinal axis X, for attaching a foam 80 which has not been depicted; and a distal third part 67, separated from the second part 66 by a foam retaining end stop 61, arranged transversely on the entire perimeter of the core 40 and forming a flange around same. The third part 67 comprises projecting elements 68 together forming a brush portion, notably for the application of product and the separation of the eyelashes, particularly the eyelashes in the corner of the eye, or of the eyebrows when applying make up. The projecting elements 68 and the retaining elements 60 are arranged around the entire periphery of the core 40. In this example, the foam is attached at least by the retaining elements 60 designed to penetrate the foam and by the retaining end stop 61 designed to retain the foam longitudinally, on one side.

Figure 11:
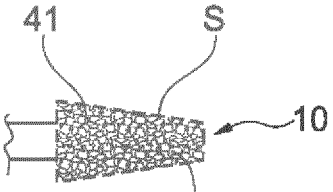
Figure 12:
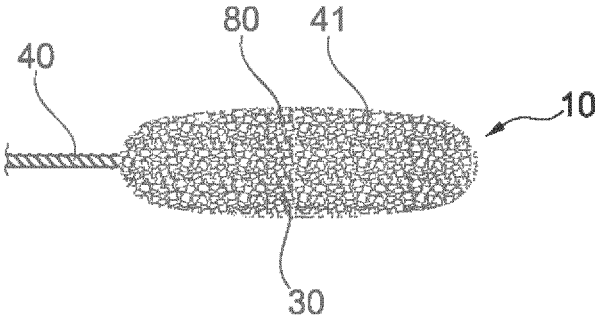

The shape of the envelope surface S of the block of foam 41 after machining may be varied. In particular, as illustrated in FIG. 11, it may be frustoconical. In FIG. 12, the shape of the foam 80 of which the application element 30 is made is ovoid. In this example also, the core 40 comprises two metal arms which have been pushed through the block 41 of foam and then twisted together, trapping the foam 80 and thus providing mechanical attachment of the foam 80.

Figure 13:
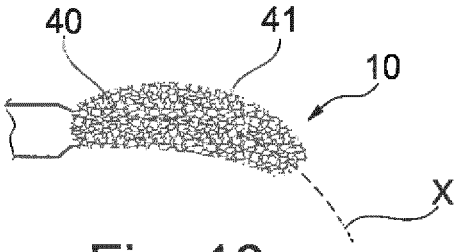

In the examples described hereinabove, the longitudinal axis X of the core is rectilinear. In the example of FIG. 13, the longitudinal axis X is curved.

Figure 14:
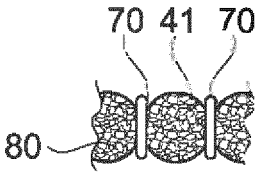
FIG. 14 is a schematic and partial side view of another example of an applicator according to the invention.

The example of FIG. 14 illustrates the possibility of attaching the block 41 of foam by crimping, notably by attaching one or more rings 70 which clamp the foam 80 against the core 40. Such an arrangement may prove advantageous, notably because it provides on the applicator zones in which the foam is not compressed, thereby constituting a reserve of product, and zones in which the foam is compressed at the site of the rings, so that in particular it exhibits a higher density of free strands and thus improves the combing/separation capabilities of the applicator in these zones.

Figure 15:
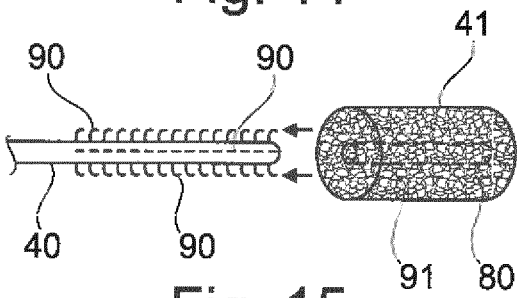
FIG. 15 is a schematic side view, prior to the attachment of the foam to the core, of another example of an applicator according to the invention.

As illustrated in FIG. 15, it is even possible to attach the block 41 of foam to the core 40 using a Velcro® system, namely an interaction of hooks and loops. In the example illustrated, hooks 90 are provided on the core 40 and the loops 91 consist of the cellular pockets of the foam 80. As an alternative which has not been illustrated, provision may be made for securing tapes of the Velcro® type, loops on the one hand and hooks on the other, to be attached to the core 40 and to the block 41 of foam.

Figure 16:
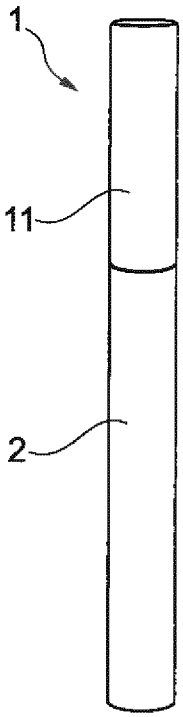
FIG. 16 depicts a packaging and application device according to another example of the invention, closed.
Figure 17:
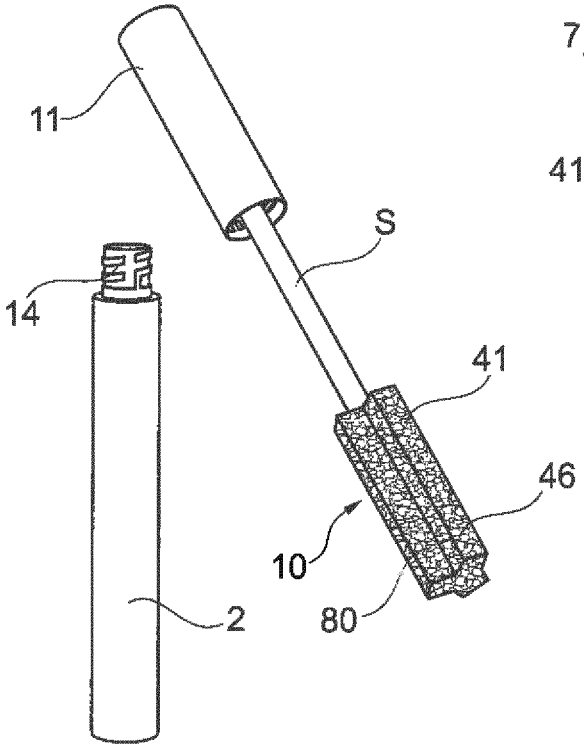
FIG. 17 schematically and in perspective depicts the device of FIG. 16, once it has been opened.
Figure 18:
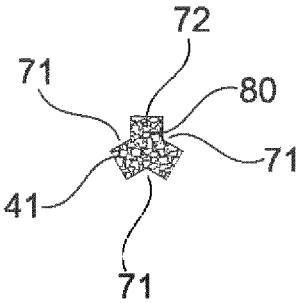
FIG. 18 is a schematic transverse view of the applicator of the device of FIG. 16.

The example illustrated in FIGS. 16 to 18, depicts the possibility of creating a packaging and application device 1 of cylindrical overall shape which has a small diameter, as illustrated in FIG. 16, yet has an applicator 10 according to the invention which is relatively large in diameter, as visible in FIG. 17. Thanks to the fact that the applicator 10 is made using foam, it can be compressed inside the container 13 and relax once it leaves this container, having passed through the wiping member (not visible in these figures but similar to that of FIG. 1). The exterior surface 46 of the foam 80 scrapes the interior walls of the container 2 and therefore cleans them as the applicator 10 is introduced into the container 2. Furthermore, the relaxation of the foam 80 as the applicator 10 is extracted from the reservoir 2 generates a "pop-up" effect, or in other words creates an applicator deployment effect that the user finds novel and distinguishing.

In this example too, the foam 80 has been machined by making notches 71 longitudinally, three of them, separated by ribs 72 which in cross section are substantially rectangular, as visible in FIG. 18.

Needless to say, the invention is not limited to the examples that have just been described.

In particular, the application element may comprise several blocks of foam constituting all or part of the application element, without departing from the scope of the invention.

Other shapes may be envisaged for the envelope surface of the application element.

The invention claimed is:

1. An applicator of cosmetic product to keratinous fibres, notably to eyelashes, eyebrows and/or capillary fibres, comprising at least:

a core that extends along a longitudinal axis, a cosmetic product application element, comprising at least one block of foam attached to the core, the foam being an open-cell polymer foam which on its outer surface has free strands formed by all or part of the edge corners of cells that have been cut through by machining of the foam, the foam having a number of cells per unit length comprised between 10 and 80 PPI in order to gently comb, separate and/or lengthen keratinous fibers.

2. The applicator according to claim 1, in which length of the free strands is comprised between approximately 0.1 mm and 4 mm.

3. The applicator according to claim 1, in which the foam is selected from cross-linked polymer foams.

4. The applicator according to claim 3, in which the foam is selected from cross-linked thermoplastic polymer foams, cross-linked polyester, cross-linked polyether or cross-linked polyethylene.

5. The applicator according to claim 1, in which the foam has a density of between 15 kg/m$^3$ and 60 kg/m$^3$.

6. The applicator according to claim 1, in which the block of foam at least partially surrounds the core in cross section.

7. The applicator according to claim 6, in which the block of foam completely surrounds the core in cross section.

8. The applicator according to claim 6, in which the block of foam partially surrounds the core over an angular extent, measured about the longitudinal axis of the core, comprised between 90° and 240°.

9. The applicator according to claim 1, in which the foam is machined by a punch, by a laser, by milling and/or by waterjet.

10. The applicator according to claim 1, in which the core is selected from a core having two arms twisted together, a rod made from a metallic material, a polymer-based core, and a combination of these.

11. The applicator according to claim 1, in which the foam is attached to the core by welding, by bonding and/or by mechanical fastening and/or the core comprising at least one retaining relief at least partially penetrating the foam and/or the core is provided with fibres at least partially passing through the foam.

12. The applicator according to claim 1, in which the application element comprises, along the longitudinal axis of the core, at least one zone with the block of foam and at least one zone provided with projecting elements or the application element is only formed by the said at least one block of foam.

13. The applicator according to claim 1, comprising a stem, the core being attached to the stem, the core having a distal end and a proximal end, the proximal end being attached to the stem, the distal end comprising a foam retaining end stop.

14. The applicator according to claim 1, in which the block of foam is fixed by means of a core having a distal portion onto which the block of foam is slipped, the distal portion being connected to a proximal portion of the core by an articulation such as a film hinge, the distal portion being folded back onto the proximal portion, complementary reliefs holding the distal portion on the proximal portion.

15. The applicator according to claim 1, in which the block of foam is attached to the core by interacting hooks and loops, the hooks being provided on the core and the loops consisting of the cellular pockets of the foam.

16. A device for packaging and applying a cosmetic product, notably to the eyelashes or eyebrows or the capillary fibres, comprising:

an applicator according to claim 1, a container containing the cosmetic product to be applied.

17. The device according to claim 16, in which the applicator comprises a stern, the core being attached to the stem, the stem of the applicator being secured to a cap that closes the container.

18. The device according to claim 16, in which the container comprises a wiping member for wiping at least the application element as the applicator is withdrawn from the container.

19. A method for manufacturing an applicator according to claim 1, comprising the following steps:

machining the exterior surface of the foam, attaching the core to the foam, the step of machining the foam taking place after or before the step of attaching the core to the foam.

20. A method according to claim 19, in which the core comprises two arms, notably U-shaped metal arms, the step of attaching the core to the foam consisting in piercing the block of foam with the two arms and then in twisting the arms together, or the core comprises two arms, twisted together and trapping fibres between them, the attachment step then consisting in making the core pass through the block of foam through a slot provided in the block of foam, or the core having a distal portion connected to a proximal portion by an articulation such as a film hinge, the method then comprising the step that consists in slipping the block of foam onto the distal portion and then folding the distal portion back onto the proximal portion, complementary reliefs holding the distal portion on the proximal portion.

21. A method according to claim 19, in which the step of securing the core to the foam involves bonding, welding and/or mechanical fastening.

22. An applicator of cosmetic product to keratinous materials, particularly to keratinous fibers, notably to eyelashes, eyebrows and/or capillary fibres, comprising at least:

a core that extends along a longitudinal axis, a cosmetic product application element, comprising at least one block of foam attached to the core, the foam being an open-cell polymer foam which on its outer surface has free strands formed by all or part of the edge corners of cells that have been cut through by machining of the foam, wherein the applicator comprises a stem, the core being attached to the stem, the core having a distal end and a proximal end, the proximal end being attached to the stem, the distal end including a foam retaining end stop, or the block of foam is fixed by means of a core having a distal portion onto which the block of foam is slipped, the distal portion being connected to a proximal portion of the core by an articulation such as a film hinge, the distal portion being folded back onto the proximal portion, complementary reliefs holding the distal portion on the proximal portion, or the block of foam is attached to the core by interacting hooks and loops, the hooks being provided on the core and the loops consisting of the cellular pockets of the foam.

* * * * *